US011517997B2

(12) United States Patent
Stark et al.

(10) Patent No.: US 11,517,997 B2
(45) Date of Patent: Dec. 6, 2022

(54) APPARATUS FOR MOUNTING ABRADERS TO FLOOR FINISHING MACHINES

(71) Applicant: DIAMOND PRODUCTIONS LTD., Montreal (CA)

(72) Inventors: Harvey Stark, Montreal (CA); Pavel Ikonomov, Laval (CA)

(73) Assignee: Diamond Productions Ltd., Montreal (CA)

( * ) Notice: Subject to any disclaimer, the term of this patent is extended or adjusted under 35 U.S.C. 154(b) by 498 days.

(21) Appl. No.: 16/824,836

(22) Filed: Mar. 20, 2020

(65) Prior Publication Data

US 2020/0298366 A1 Sep. 24, 2020

Related U.S. Application Data

(60) Provisional application No. 62/821,106, filed on Mar. 20, 2019.

(51) Int. Cl.

| | |
|---|---|
| ***B24B 41/04*** | (2006.01) |
| ***B24B 7/18*** | (2006.01) |
| *B24B 41/00* | (2006.01) |

(52) U.S. Cl.

CPC ..... *B24B 41/04* (2013.01); *B24B 7/18* (2013.01)

(58) Field of Classification Search

CPC ..... B24B 1/04; B24B 7/18
USPC ..... 451/360, 350, 352
See application file for complete search history.

(56) References Cited

U.S. PATENT DOCUMENTS

| | | | | |
|---|---|---|---|---|
| 4,155,596 | A * | 5/1979 | Brejcha | B24B 7/186 299/39.1 |
| 4,320,986 | A * | 3/1982 | Morrison | E04F 21/248 404/112 |
| 7,530,762 | B2 | 5/2009 | Reed et al. | |
| 2006/0025059 | A1 * | 2/2006 | Gueorguiev | B24B 41/047 451/350 |

* cited by examiner

*Primary Examiner* — Joseph J Hail
*Assistant Examiner* — Shantese L McDonald
(74) *Attorney, Agent, or Firm* — Bradley J. Thorson; DeWitt LLP

(57) ABSTRACT

An adapter plate for use with a floor finishing machine for coupling abrasive drive plates to the spider arms of the floor finishing machine which includes a plurality of stamped plate components which when joined together form a polygon on which is mounted a plurality of hub members in which shafts are journaled for rotation in a spherical bearing. The shafts are, in turn, coupled to the abrasive drive plates.

6 Claims, 12 Drawing Sheets

APPARATUS FOR MOUNTING ABRADERS TO FLOOR FINISHING MACHINES

CROSS-REFERENCED TO RELATED APPLICATIONS

This application is a non-provisional application of Application No. 62/821,106, filed Mar. 20, 2019, and claims priority from that application which is also deemed incorporated by reference in its entirety in this application.

STATEMENT REGARDING FEDERALLY SPONSORED RESEARCH OR DEVELOPMENT

Not applicable

BACKGROUND OF THE INVENTION

I. Field of the Invention

The present invention relates generally to power machines for finishing concrete floors, and more particularly to an apparatus for mounting a plurality of rotatable drive plates to the rotary arms of either ride-on or walk-behind floor finishing machines.

II. Discussion of the Prior Art

In creating concrete slabs such as flooring, wet concrete is troweled or floated to apply a smooth, level finish to concrete slabs. When the project is of any size, so-called power trowels are commonly employed. They may be of a walk-behind variety or a ride-on type, such as is depicted in FIG. 1 of the Reed et al U.S. Pat. No. 7,530,762.

Once the concrete has been troweled and has set, it is often desired to provide the concrete floor with a polished finish and this is often done with a separate machine used to abrade the concrete surface with motor driven rotary drive plates supporting diamond abrasive members of various grit sizes.

To avoid the substantial cost of providing separate machines for doing the troweling and later polishing steps, it is known in the art to convert a power trowel to a floor polishing machine by attaching abrader drive plates to the existing rotary structure or structures of power trowels. The afore-referenced Reed '762 patent describes an arrangement for converting a power trowel to a concrete finishing machine used to polish the surface of cured concrete to produce a satin, shiny finish.

The present invention is concerned with the design of an adapter to facilitate conversion of a power trowel to a power floor finishing machine.

SUMMARY OF THE INVENTION

The present invention comprises an adapter assembly including a plurality of stamped plates, each shaped so that when secured to the spider arms of a power trowel or to those of a powered floor finishing machine, they form a closed, multi-sided, irregular polygonal-shaped ring. Each of the plates has opposed end portions with one or more projecting fingers that interlace with the fingers on the end portion of an adjacently positioned plate. A pair of radially aligned apertures are located proximate the opposed end portions of the plates for receiving U-bolts that join adjacent plates to one another and that also clamp the joined plates to an arm of the power trowel's spider. Further, each of the plates includes a central aperture and fastened over the aperture is a hub assembly containing a spherical bearing for journaling the drive shaft of a tool plate on which is affixed a plurality of abrasive elements.

As the spider is driven, the abrasive elements on the drive plate engage the concrete surface to smooth out surface irregularities. The use of a spherical bearing with the shaft of the rotatable drive plate allows the drive plate to ride over and smooth out any bumps or depressions encountered on the concrete's surface.

BRIEF DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
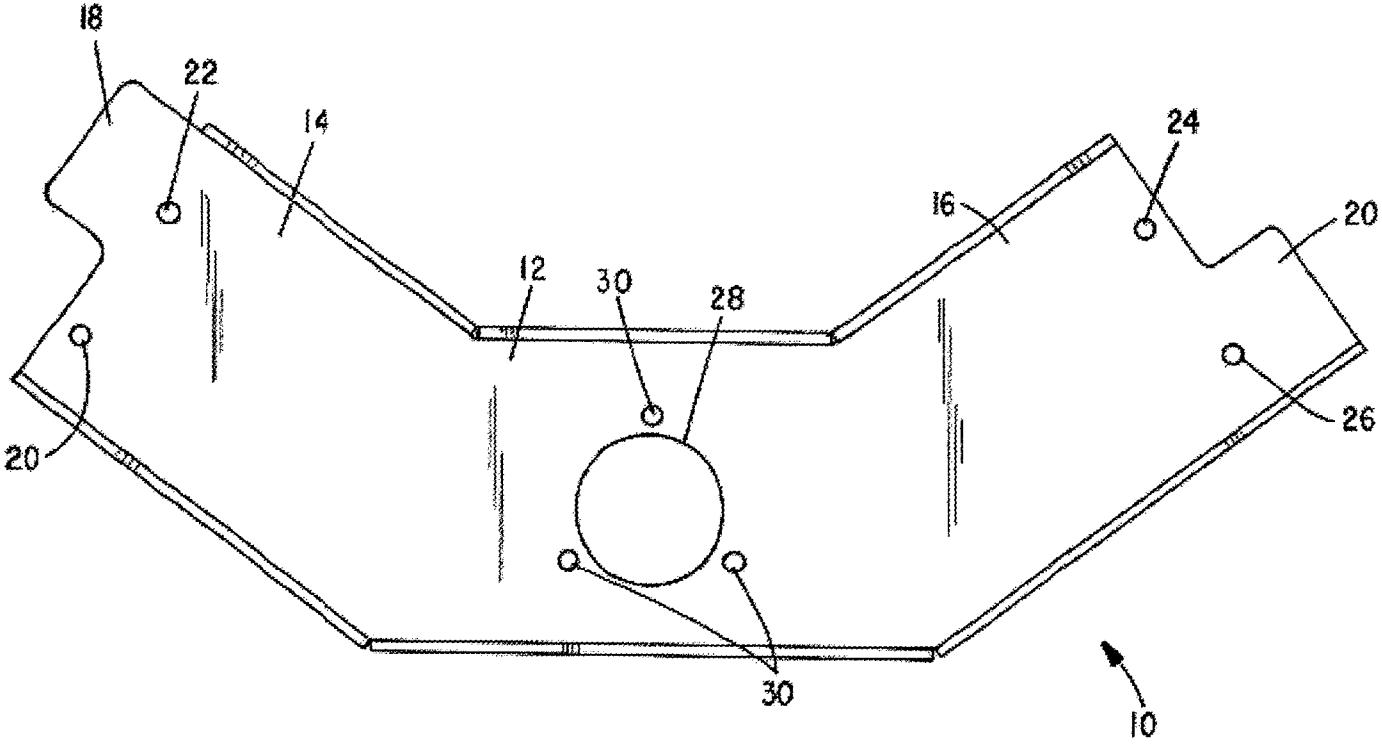
FIG. 1 is a top plan view of an adapter plate constructed in accordance with the present invention.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

FIG. 1 shows a first embodiment of an adapter plate component designed to extend between two adjacent arms of a motor driven spider of a power trowel or a floor finishing machine. It is indicated generally by numeral 10 and includes a center section 12, a left hand section 14 and a right hand section 16 where the left hand section and the right hand section extend obliquely at a predetermined angle to the center section 12. Each of the left and right sections of the plate component 10 includes a generally rectangular protruding finger portion 18 and 20 that extends only partway across the width dimension of the segments 14 and 16. First and second holes 20 and 22 extend through the thickness dimension of the plate component proximate the end portion of the section 14 while similar holes 24 and 26 are located proximate the end of the right section 16.

Formed through the thickness dimension of the center section 12 is a circular aperture 28 and spaced about it at equal circumferential positions are three threaded holes 30.

Figure 2:
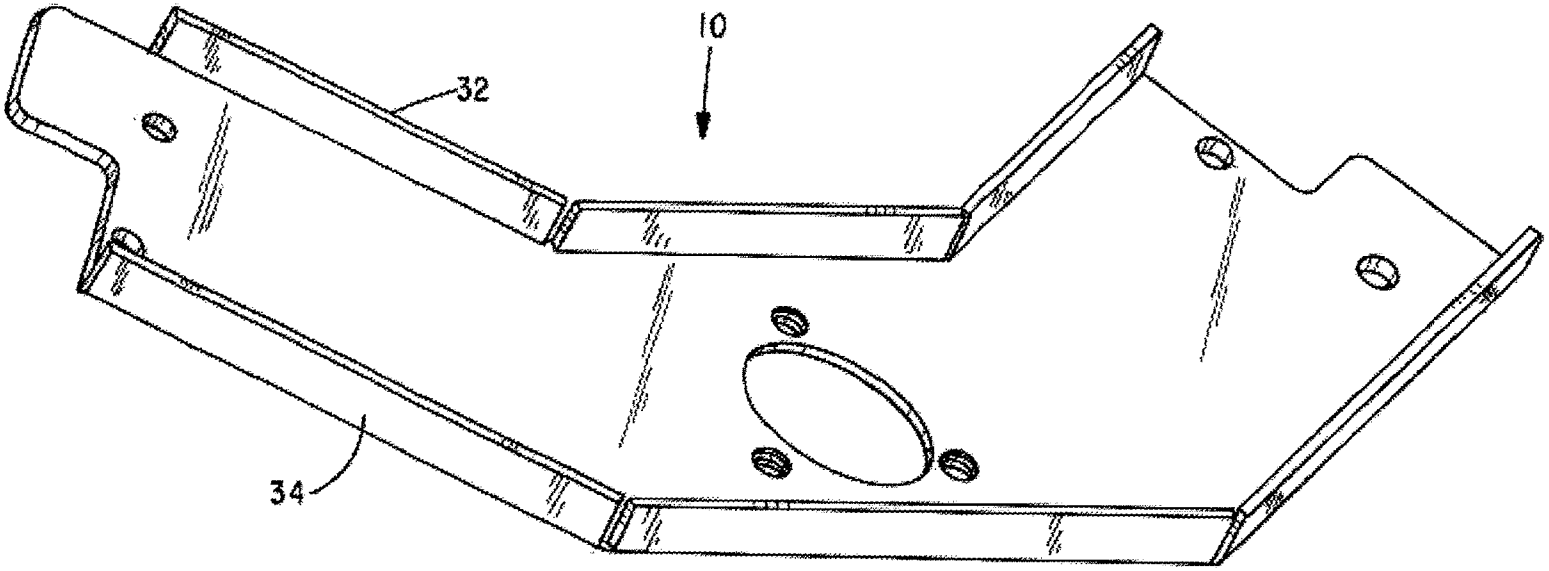
FIG. 2 is a perspective view thereof.

To provide greater rigidity against bending, the outer and inner edges of the plate 10 are bent at 90° and the resulting sidewalls are identified by numerals 32 and 34 in FIG. 2.

Figure 3:
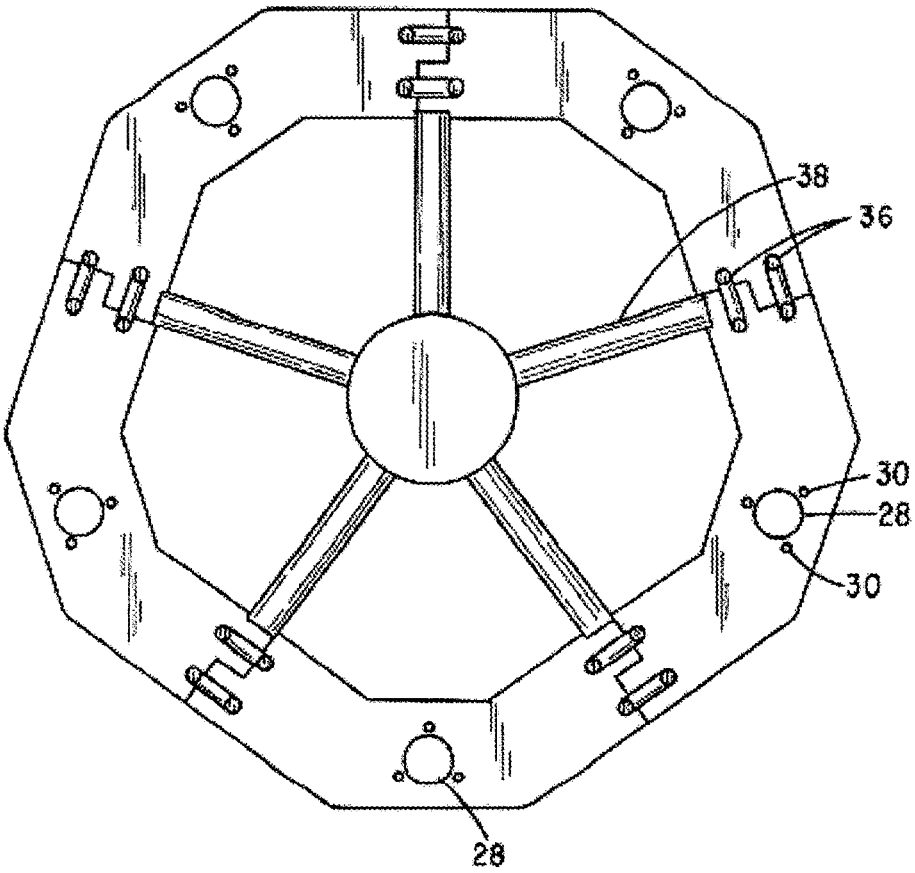
FIG. 3 is a bottom plan view showing five of the plates of FIG. 1 joined to one another to form an adapter assembly.
Figure 4:
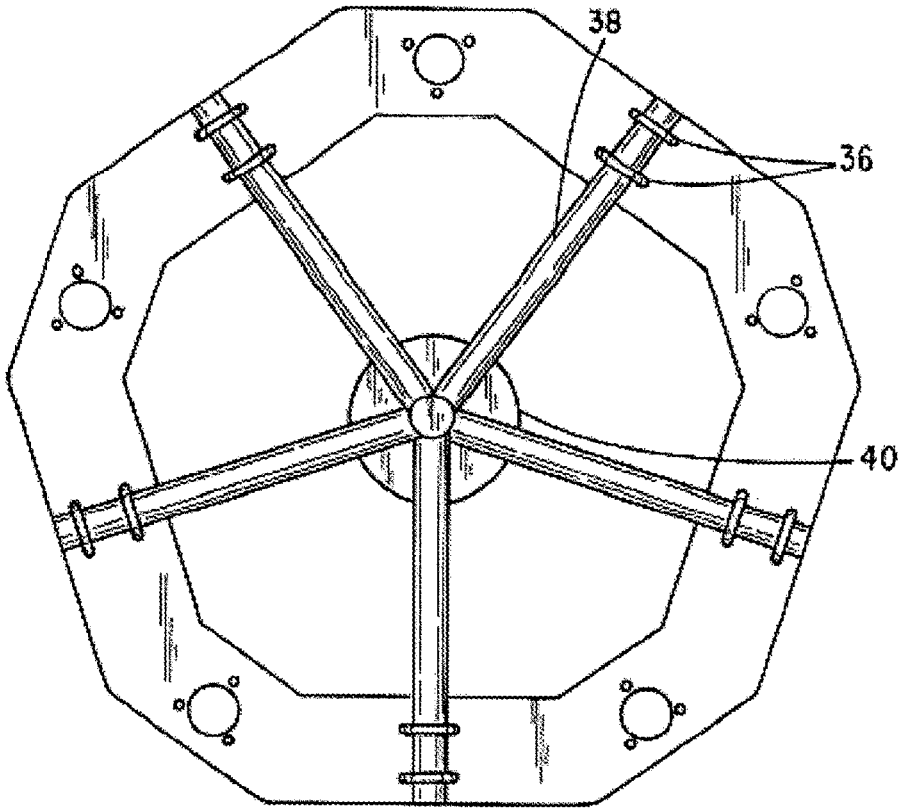
FIG. 4 is a top plan view of the adapter assembly.
Figure 5:
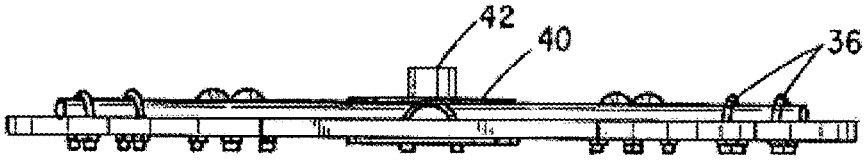
FIG. 5 is a side elevation view of the adapter assembly.

Turning next to FIGS. 3 and 4, five of the plate components 10 of FIG. 1 are joined end to end to create an irregular decagon. As seen in these views, U-bolts 36 pass through the holes 24 and 26 on a given one of the plate components 10 and through the holes 20 and 22 on a next adjacent one of the plates 10. The ends of the U-bolts are threaded in a conventional fashion to receive threaded nuts for securing the adjacent plates one to the other and to an associated one of the spider arms, such as arm 38 in FIG. 4. The plural spider arms of a power trowel or floor finisher come together at a central hub 40 having a vertical shaft 42 (FIG. 5) that becomes joined to a drive shaft (not shown) of a prime mover of the power trowel or power floor finisher. Because of the way that the finger-like extensions 18 and 20 are offset from one another, they fit into the recess on the end portion of an adjacent plate component when assembled, as shown in FIGS. 3 and 4.

Figure 6:
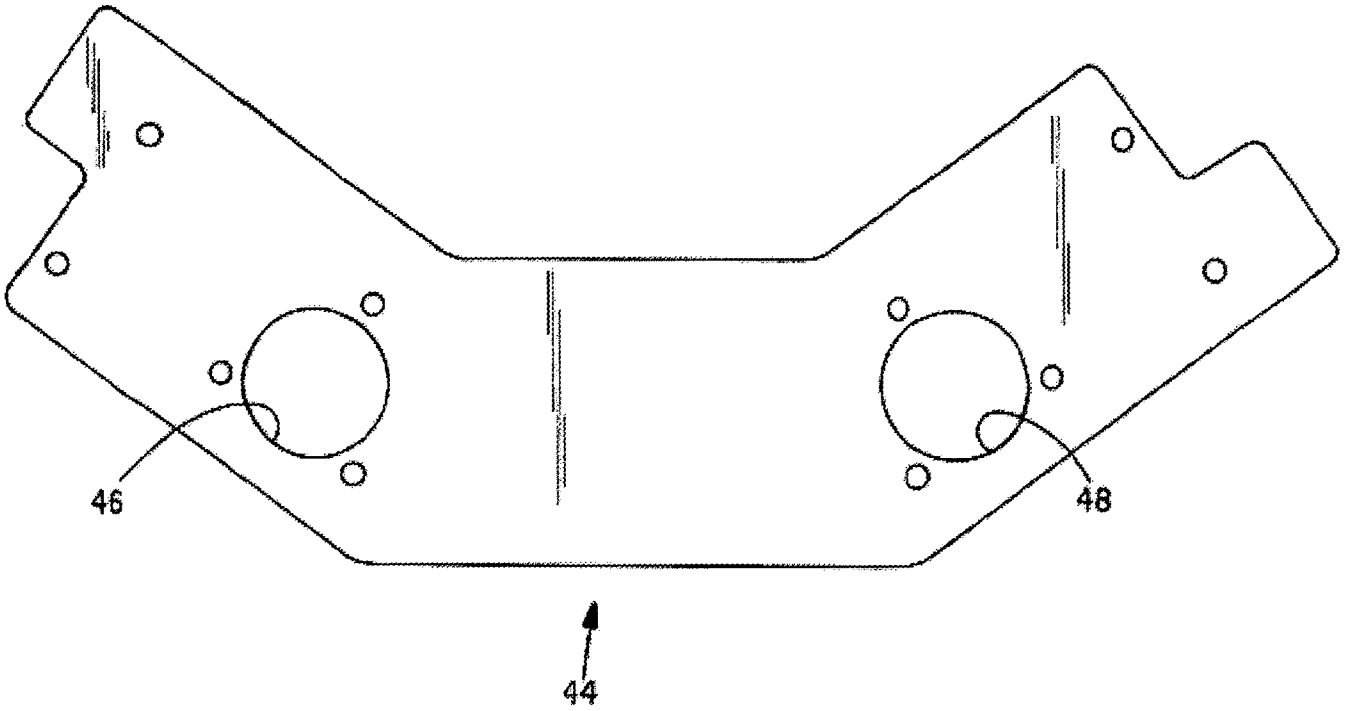
FIG. 6 is a top plan view of an alternative mounting plate component.
Figure 7:
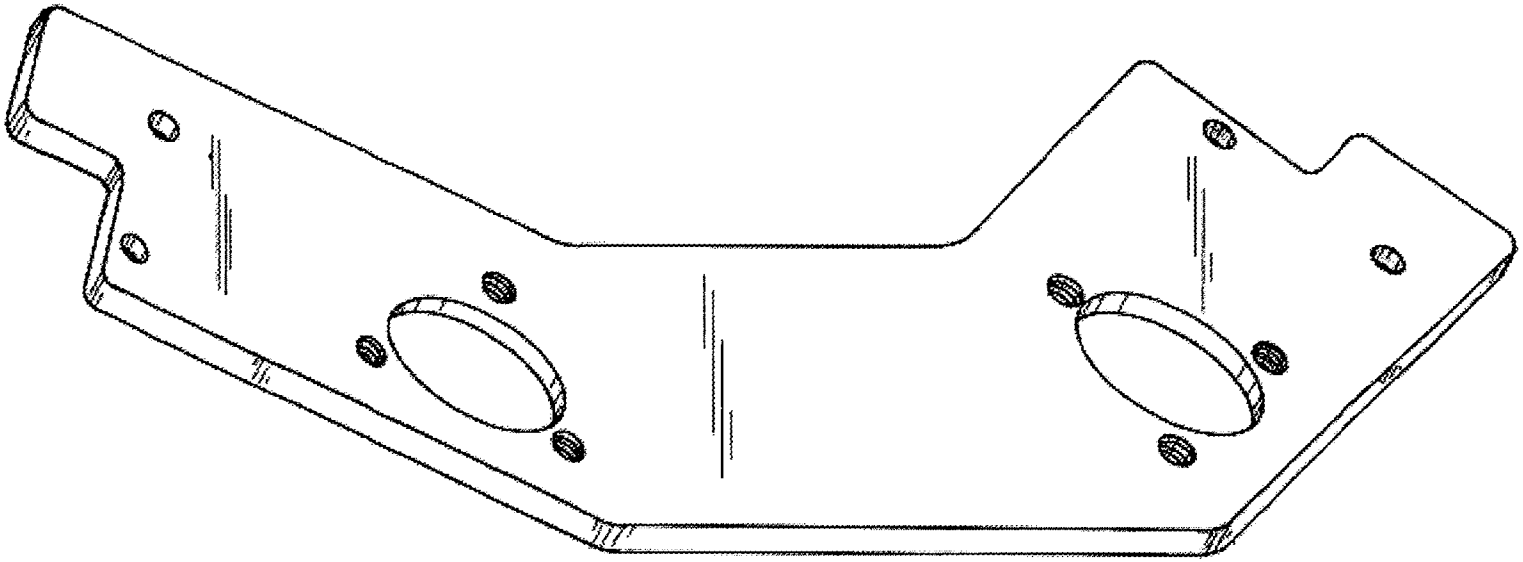
FIG. 7 is a perspective view thereof.

When it is recognized that in power trowels, such as shown in FIG. 1 of the Reed et al '762 patent, the spiders on separate drives may rotate in opposite directions, it has been found preferable to use plate components like those shown in FIGS. 6 and 7 in place of the ones shown in FIGS. 1 and 2. The plate design shown in FIGS. 6 and 7 provide alternate mounting locations for drive plates depending upon whether the adapter supporting the drive plates will be rotated clockwise or counter-clockwise.

The plate 44 of FIG. 6 differs from that of FIG. 1 primarily in the relocation and the number of bearing-mounting apertures employed. In FIG. 1, there is only a single bearing-mounting aperture 28. In the plate 44 of FIG. 6, there are two such apertures 46 and 48. Also, in the embodiment of FIG. 6, there are no walls like the walls 32 and 34 shown in FIG. 2.

Without limitation, the flat mounting plate component 44 is preferably of steel, but could be of a suitable plastic. It preferably may have a thickness in the range from 3 mm to 10 mm. If the plate is provided with the upturned walls 32 and 34, it need only be steel of 4 mm in thickness, whereas, if it is a flat assembly, like that shown in FIGS. 6 and 7, a thickness of 8 mm is more appropriate.

Figure 8:
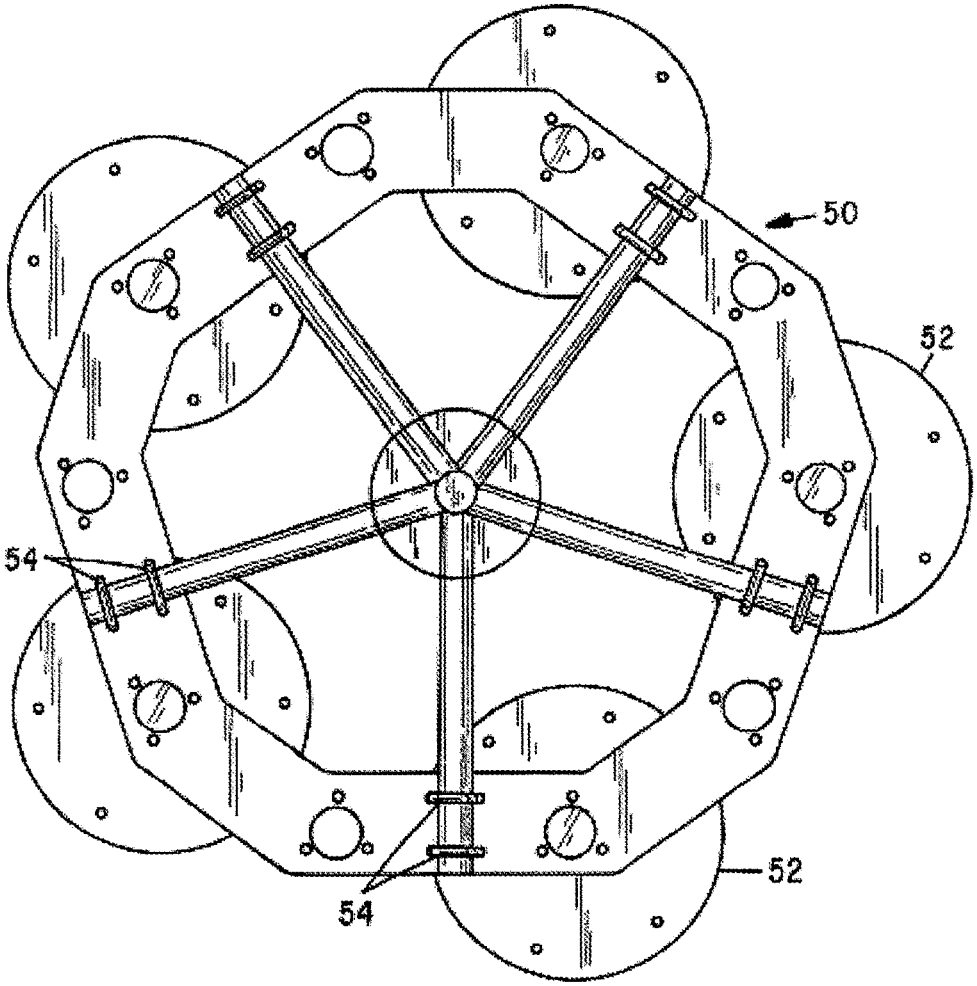
FIG. 8 is a top plan view of the adapter assembly joined to the arms of a spider that comprises a component of a power trowel or a power floor finisher and with a plurality of circular drive plates mounted to the adapter.
Figure 9:
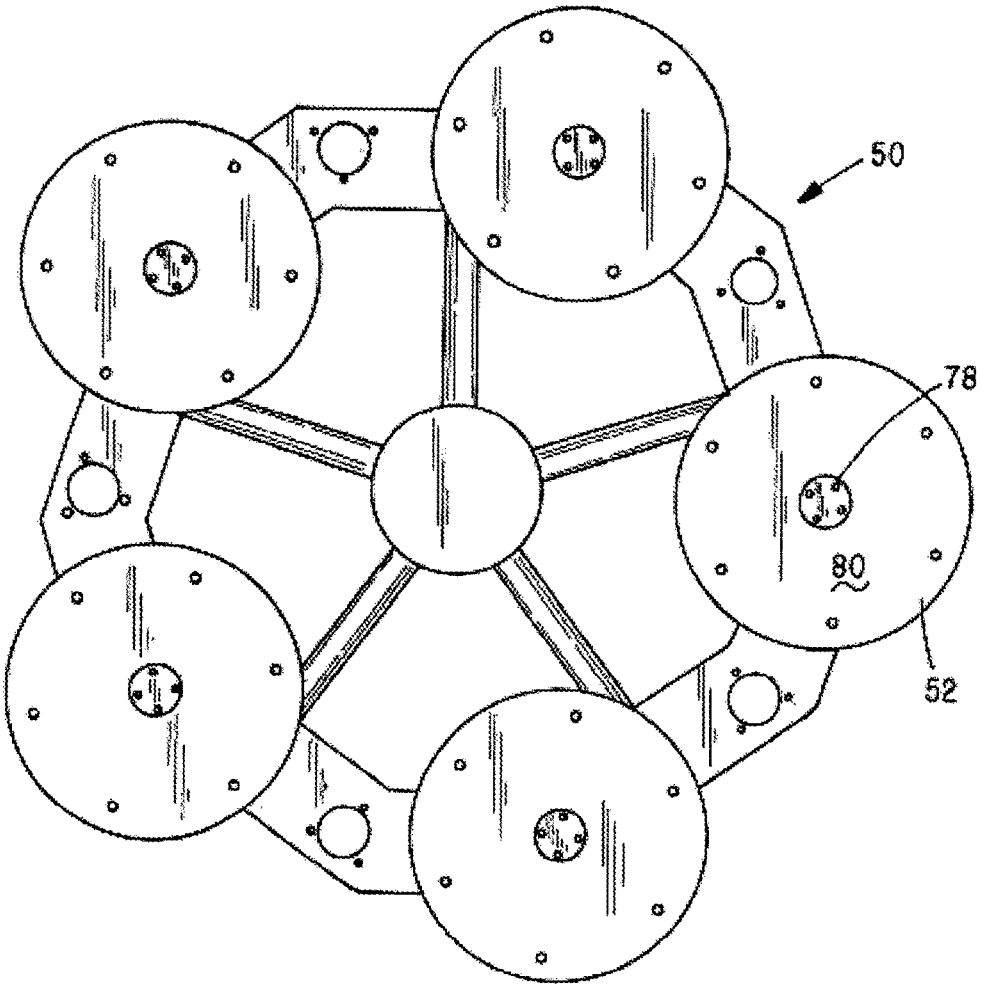
FIG. 9 is a bottom plan view of the adapter assembly and the drive plates mounted thereon.
Figure 10:
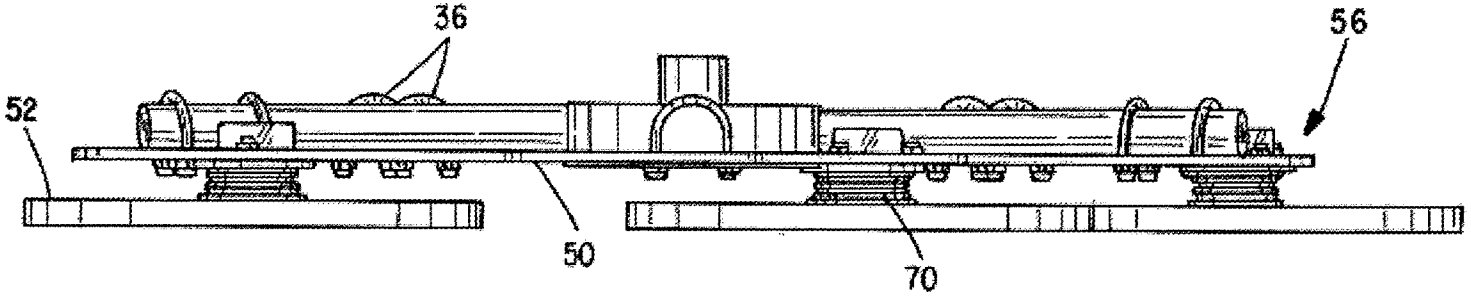
FIG. 10 is a side elevation view of the adapter assembly affixed to spider arms and with drive plates rotatably journaled thereto.

FIGS. 8 and 9 show an assembled drive plate adapter ring 50 comprising five plates like that of FIG. 6 joined one to the other to form an irregular decagon. The adapter ring 50 is employed to mount five drive plates, as at 52, each having suitable abrasives affixed to its floor-facing surface. Again, U-bolts, as at 54, are used to join adjacent ones of the adapter plate components 44, one to the other, while at the same time, affixing the composite adapter ring to the arms of a spider of a power trowel or other floor finishing machine.

The mounting plate component 10 and 44, shown in FIGS. 1, 2, 6 and 7 are designed to be used with a machine spider having five arms. Those skilled in the art will appreciate that, if the machine spider has fewer or a greater number of arms at the size and shape of the mounting plate components, will change accordingly. For example, with the five-arm spider shown in the drawings, the individual plate components comprising the composite mounting plate or ring will span an arc of 72°. Whereas, if the spider has four arms, each plate component will span 90° and, if the spider has six arms, each would have to span an arc of 60°. Given the present teachings, the shape of the joint where two such plate components connect to one another will also change and such a modification is well within the level of ordinary skill in the art.

Figure 11:
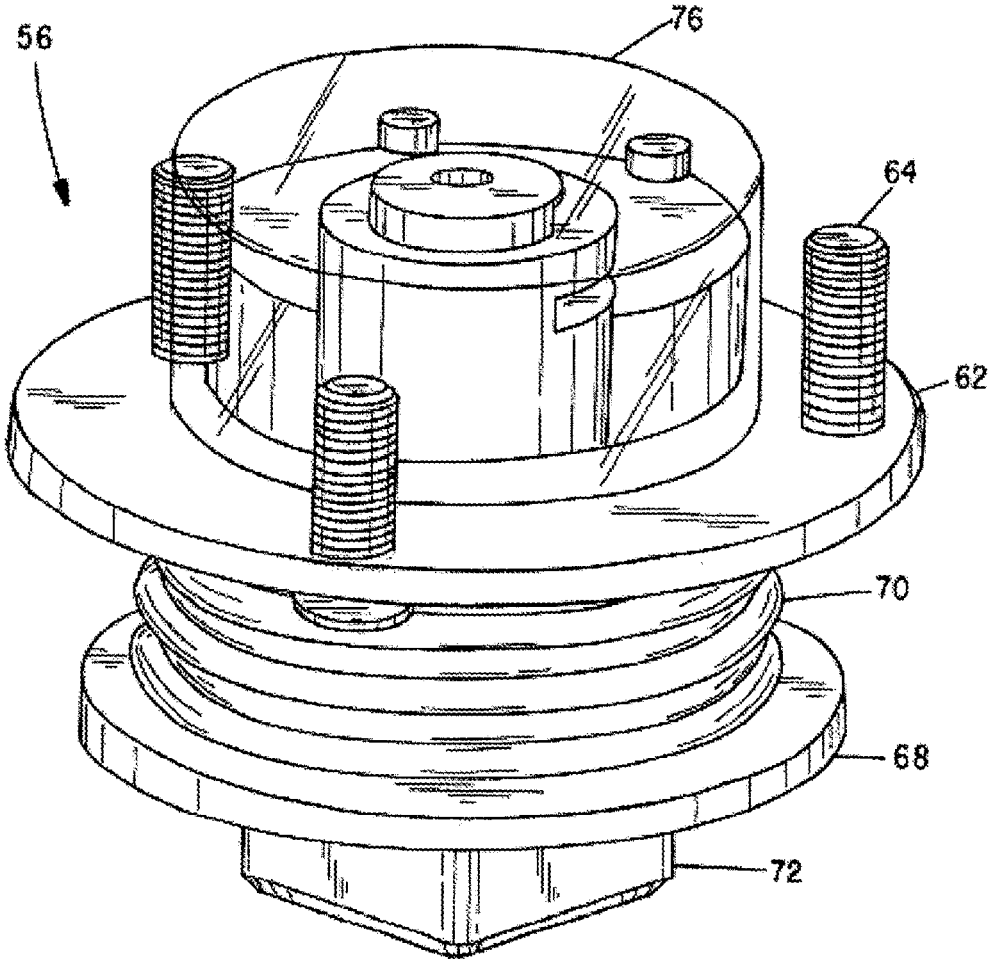
FIG. 11 is a perspective view of a bearing assembly used to journal a drive plate to the adapter of the present invention.
Figure 12:
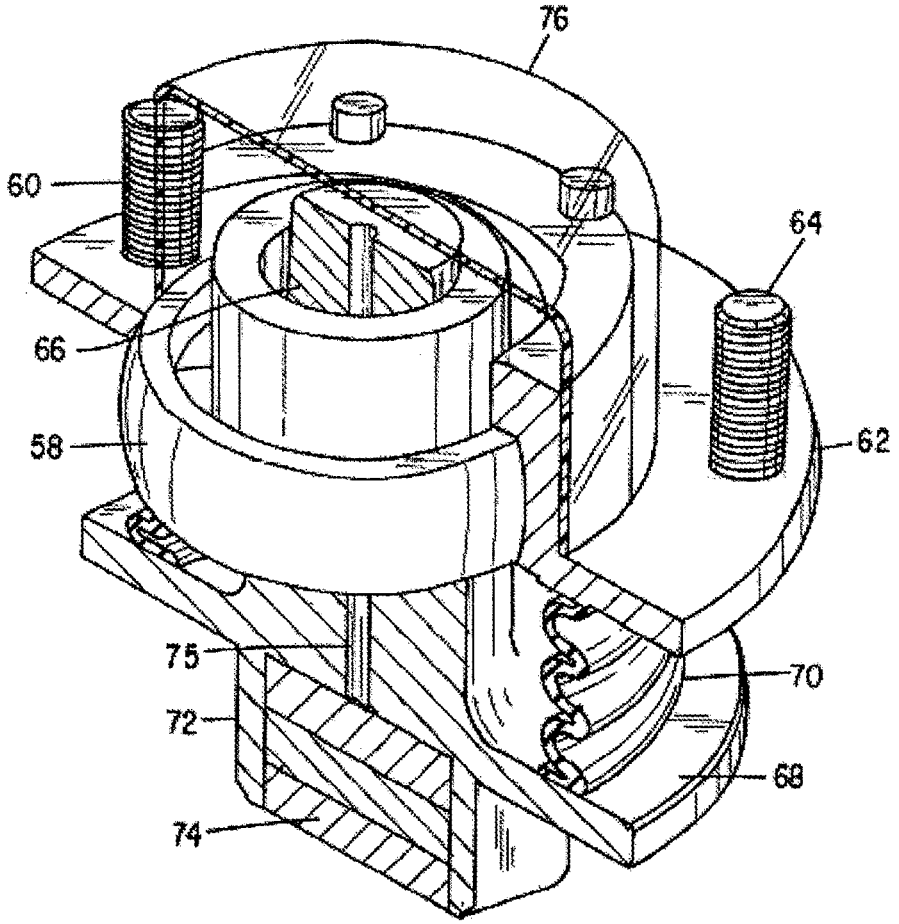
FIG. 12 is a vertical cross section taken through the bearing assembly of FIG. 11.

Turning next to FIGS. 11 and 12, there is shown the design of a mounting hub used to join circular abrasive drive plates to a composite mounting plate like plate 52 in FIGS. 8 and 9. The hub is indicated generally by numeral 56 and comprises a spherical swivel bearing 58 inserted in a complimentary shaped hub member 60 that has a flange 62 that becomes fixed by bolts 64 to the underside of the composite ring or plate 50 shown in FIG. 8 and with a head portion projecting through an aperture 28 (FIG. 1).

Journaled for rotation and tilting by way of the swivel bearing 58 is a shaft 66 having an integrally formed flange 68. Captured between the flange 68 and the flange 62 of the bearing hub 60 is an elastomeric dust bellows 70. Integrally joined to the shaft 66 below the flange 68 is a box-like housing 72 which is adapted to contain one or more permanent magnets as at 74 in FIG. 12. A bore 75 is provided between the magnet housing 72 and the upper end of the tool plate drive shaft 66 to allow entrained air to escape as the magnets are inserted during manufacture. A dust cap 76 is designed to snap onto the hub member 60 which, along with the dust bellows 70, serve to shield the bearing surfaces from dust and debris created during use of the machine in grinding/polishing concrete or other stone surfaces.

Referring back to FIG. 9, the drive plates 52 preferably comprise a heat resistant plastic, such as Dispel® plastic, and having a ferrous metal central slug 78 mounted therein which, when acted upon by the magnets 74, adheres the drive plate to the end of the shaft 66 of the hub assembly 56. As is well known in the art, diamond abrasives or other types of abrasives (not shown) mount to the bottom surface 80 of the drive plate 52 to interface with a floor surface being treated.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

The invention claimed is:

1. Apparatus for mounting abrasive carrying drive plates to spider arms of a floor finishing machine comprising:

(a) a plurality of adapter plate components, each adapted to extend between adjacent radially extending spider arms of a floor finishing machine, and including at least one aperture extending through a thickness dimension of the adapter plate components and where end portions of the adapter plate components include protruding rectangular finger portions that extend partially across a width dimension of the adapter plate component;

(b) a plurality of threaded fasteners adapted to join finger portions of adjacent ones of the adapter plate components to one another and to a spider arm to create a closed polygon;

(c) at least one hub member offered to each of the adapter plate components having a shaft journaled in a spherical bearing and extending through the at least one aperture; and (d) an abrasive carrying drive plate coupled to each of said shafts.

2. The apparatus of claim 1 wherein the closed polygon is a decagon.

3. The apparatus of claim 1 wherein the shaft of the hub member includes a socket containing at least one permanent magnet for releasably coupling the shaft to an abrasive carrying drive plate.

4. The apparatus of claim 1 wherein the hub member includes means for shielding the spherical bearing from ingress of dust arising during floor finishing operations.

5. The apparatus of claim 1 wherein each of the adapter plate components includes upturned side walls.

6. The apparatus of claim 1 wherein the threaded fasteners comprise U-shaped bolts having a pair of legs where a first leg passes through an aperture in one adapter plate component and a second leg passes through an aperture in an adapter plate component adjacent the one adapter plate component while capturing a spider arm.

* * * * *